US005510672A

United States Patent [19]

Washio et al.

[11] Patent Number: 5,510,672

[45] Date of Patent: Apr. 23, 1996

[54] FLUORESCENT DISPLAY DEVICE

[75] Inventors: Yoshiaki Washio; Hiroshi Yamaguchi, both of Mobara, Japan

[73] Assignee: Futaba Denshi Kogyo K.K., Mobara, Japan

[21] Appl. No.: 183,348

[22] Filed: Jan. 18, 1994

[51] Int. Cl.[6] ..... H01J 31/15

[52] U.S. Cl. ..... 313/497; 313/496; 345/74; 345/75; 315/169.4

[58] Field of Search ..... 313/495, 496, 313/497, 471, 505, 483, 485; 315/169.1, 169.2, 169.3, 169.4, 326, 334, 335, 336, 337; 345/74, 75

[56] References Cited

U.S. PATENT DOCUMENTS 5,036,247 7/1991 Watanabe et al. ..... 313/496

OTHER PUBLICATIONS

Tadanashi Nabumara; Spotlighting Display Devices—VFD "Itron VFDs Become Word Processing Displays"; pp. 57–60; May 1980.

Mitsuru Tamura; "Developmental Pace Picking up for VFDs for TV Video Image"; Fluorescent Displays; Sep. 1981; pp. 55–59.

*Primary Examiner*—Donald J. Yusko

*Assistant Examiner*—Nimesh D. Patel

*Attorney, Agent, or Firm*—Oblon, Spivak, McClelland, Maier & Neustadt

[57] ABSTRACT

A dot matrix type fluorescent display device including anode segments arranged at fine pitches is provided which is capable of facilitating arrangement of grids and substantially preventing leakage luminance. A plurality of anode segments are arranged to defined a matrix. Each three wiring conductors are arranged for every anode row. The anode segments in each row are connected to the same writing conductors at every third interval. Each one mesh grid is arranged in correspondence to every two columns of anode segments. The anodes each are arranged so as to outwardly extend by distance one third as large as a dimension thereof from the grid. Each adjacent two grids are applied thereto a positive potential and shifted one by one. Of four columns of anodes corresponding to two grids, two columns of anodes positioned inside the grids are fed with a display signal. Unselected anodes adjacent thereto are likewise fed with the display signal, however, impingement of electrons on the unselected anodes is effectively prevented because an interval between the grids adjacent to each other is increased.

2 Claims, 5 Drawing Sheets

FLUORESCENT DISPLAY DEVICE

BACKGROUND OF THE INVENTION

This invention relates to a fluorescent display device of a triode structure including an anode, a cathode and a mesh grid, and more particularly to a fluorescent display device of the dot matrix type wherein a plurality of anode segments are arranged in a matrix-like manner at fine pitches.

A conventional fluorescent display device of this type is disclosed in Japanese Patent Publication No. 202050/1982, which is generally constructed in such a manner as shown in FIG. 4. More specifically, the fluorescent display device includes a plurality of dot-like anode segments arranged in a matrix-like manner. Each of rows of the matrix is provided with three wiring conductors a, b and c and the anode segments A of each row are connected to the same wiring conductor at every third interval. Grids G each are arranged for every two columns of the matrix. At the time of driving of the fluorescent display device, each adjacent two grids are concurrently fed with a positive scan signal and circulatingly scanned while shifting the grids one by one in a predetermined direction. The grids G which are not fed with a display signal are fed with a negative scan signal. Then, of the anode segments A of four columns corresponding to the two grids G fed with the positive scan signal, the anode segments A of two columns on an inside or a side on which both grids G are adjacent to each other are fed with a display signal at a timing in synchronism with scanning of the grids G.

In general, a fluorescent display device has been improved so as to provide a display highly densified depending on applications thereof. The conventional graphic fluorescent display device described above is likewise subject to high densification of the anode segments, so that there is a tendency that pitches at which the anode segments are arranged are reduced. For example, when the anode segments are formed into a square of which one side is 0.45 mm and arranged at pitches of 0.65 mm, a distance between each adjacent two anode segments is caused to be only 0.2 mm. Thus, in the conventional graphic fluorescent display device, it is required to arrange side edges of each two mesh grids opposite to each other at an interval as small as 0.1 mm or less in such a reduced space between each adjacent two anode segments while preventing contact between the side edges of the mesh grids opposite to each other. Arrangement of the mesh grids with such high accuracy requires skill. In this instance, biased arrangement of the mesh grids between the anode segments causes some disadvantages.

More specifically, as shown in FIG. 5, when, of the anode segments A3 and A4 of two columns positioned inside two grids G2 and G3 which are fed with a positive scan signal, the anode segment A4 of one column is fed with a display signal, the next anode segment A1 but two is likewise fed with the display signal. A mesh grid G1 corresponding to the anode segment A1 is fed with a negative scan signal, to thereby normally prevent electrons from impinging on the anode segment A1. However, when an edge of the mesh grid G1 is biasedly arranged so as to be in proximity to an edge 100 of the anode segment A1, a positive electric field of the mesh grid G2 adjacent thereto causes electrons to fly into the edge 100 of the anode segment A1, leading to leakage luminance.

SUMMARY OF THE INVENTION

The present invention has been made in view of the foregoing disadvantage of the prior art.

The present invention is directed to a dot matrix type fluorescent display device which includes anode segments arranged at fine pitches.

It is an object of the present invention to provide a dot matrix type fluorescent display device which is capable of facilitating arrangement of mesh grids.

It is another object of the present invention to provide a dot matrix type fluorescent display device which is capable of substantially preventing leakage luminance.

In accordance with the present invention, a fluorescent display device is provided. The fluorescent display device includes an anode substrate constituting a part of an envelope, anode segments each having a phosphor deposited thereon and arranged on an inner surface of the anode substrate, and mesh grids provided in the envelope so as to face the anode segments. The anode segments each are arranged so as to cover an outer edge of each of the mesh grids in a direction of arrangement of the mesh grids, resulting outwardly projecting at a part thereof from the mesh grid.

In a preferred embodiment of the present invention, the anode segments each are formed into a dot-like shape and a plurality of the anode segments are controlled by one of the mesh grids.

In a preferred embodiment of the present invention, a plurality of the anode segments are arranged in a matrix-like manner, a plurality of wiring conductors are arranged for every row of the matrix, the anode segments arranged in each row are connected to the same wiring conductors at every predetermined interval, and the mesh grids are arranged one by one for every two rows of the anode segments.

In the fluorescent display device of the present invention described above, when the mesh grids and the anode segments arranged so as to partially outwardly extend from the mesh grids are applied thereto a predetermined positive voltage, electrons are caused to impinge on the extending portion of each of the anode segments as well, to thereby prevent a display defect. Also, the above-described construction of the present invention permits an interval between the mesh grids to be significantly increased, to thereby prevent unselected anode segments from being affected by the mesh grids adjacent thereto to which a positive voltage is applied.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a fluorescent display device according to the present invention will be described hereinafter with reference to FIGS. 1 to 3.

Figure 1:
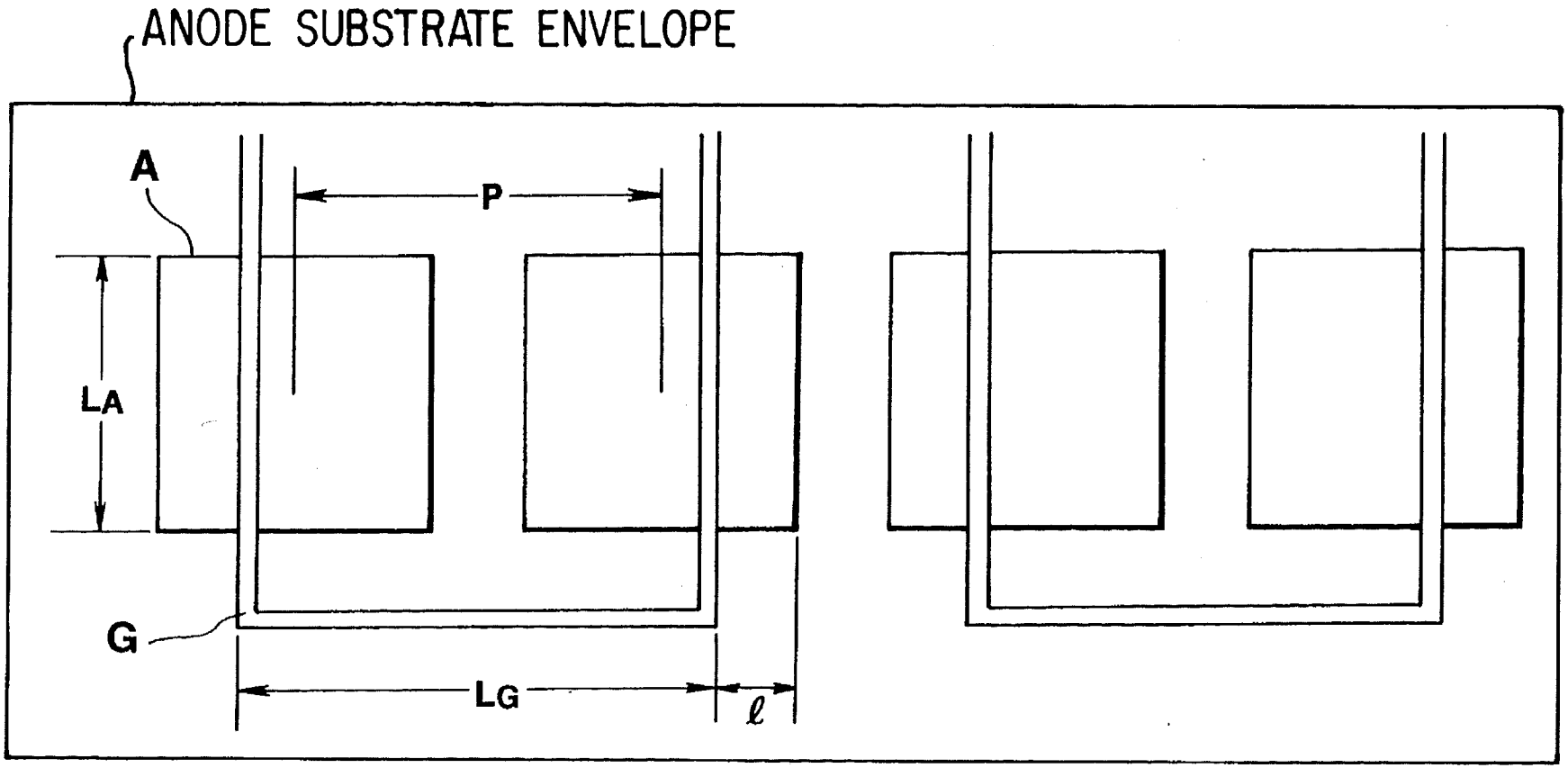
FIG. 1 is an enlarged plan view showing an essential part of a first embodiment of a fluorescent display device according to the present invention.
Figure 2:
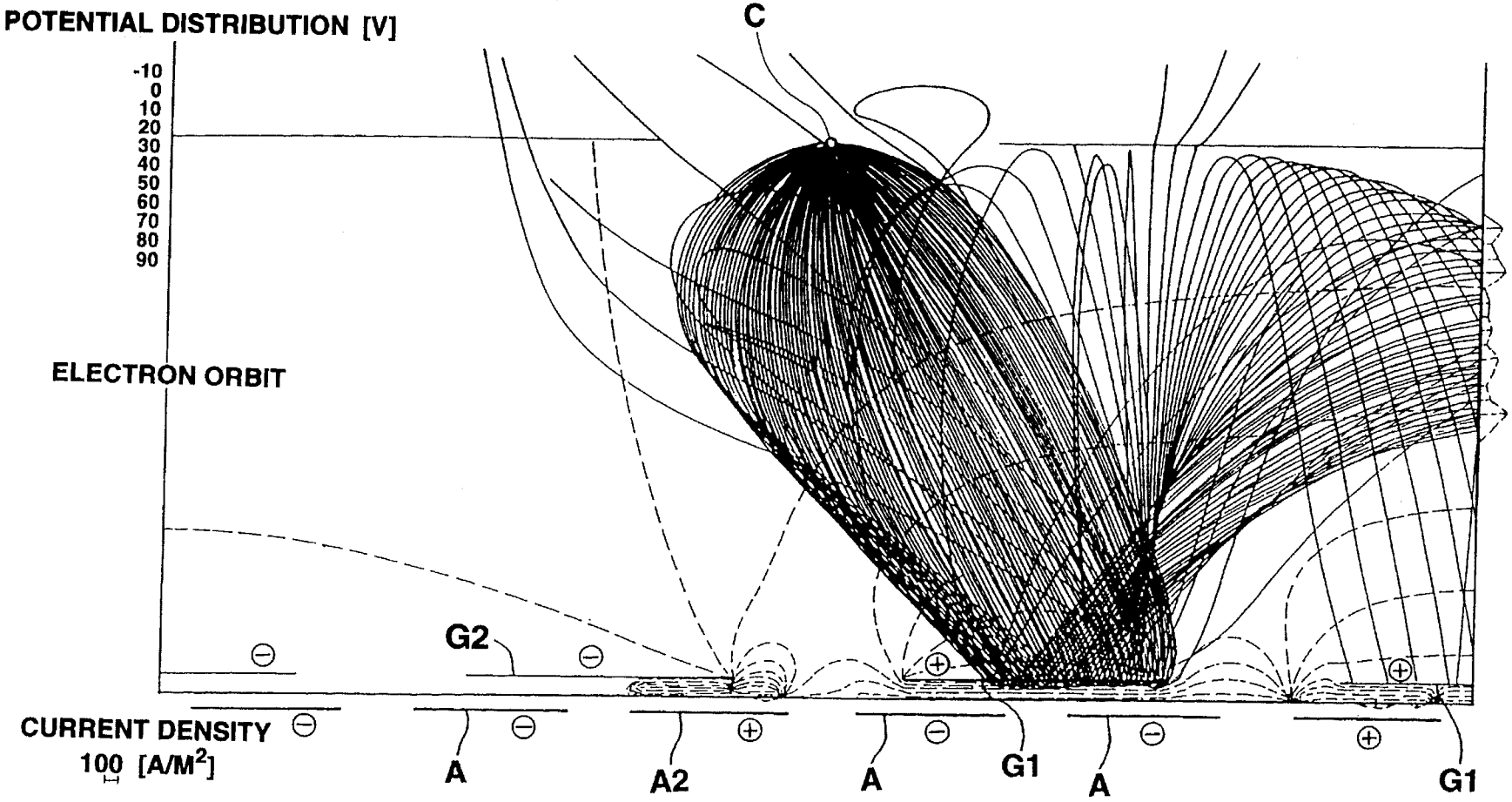
FIG. 2 is a graphical representation showing electron orbits and a potential distribution in the fluorescent display device of FIG. 1.
Figure 3:
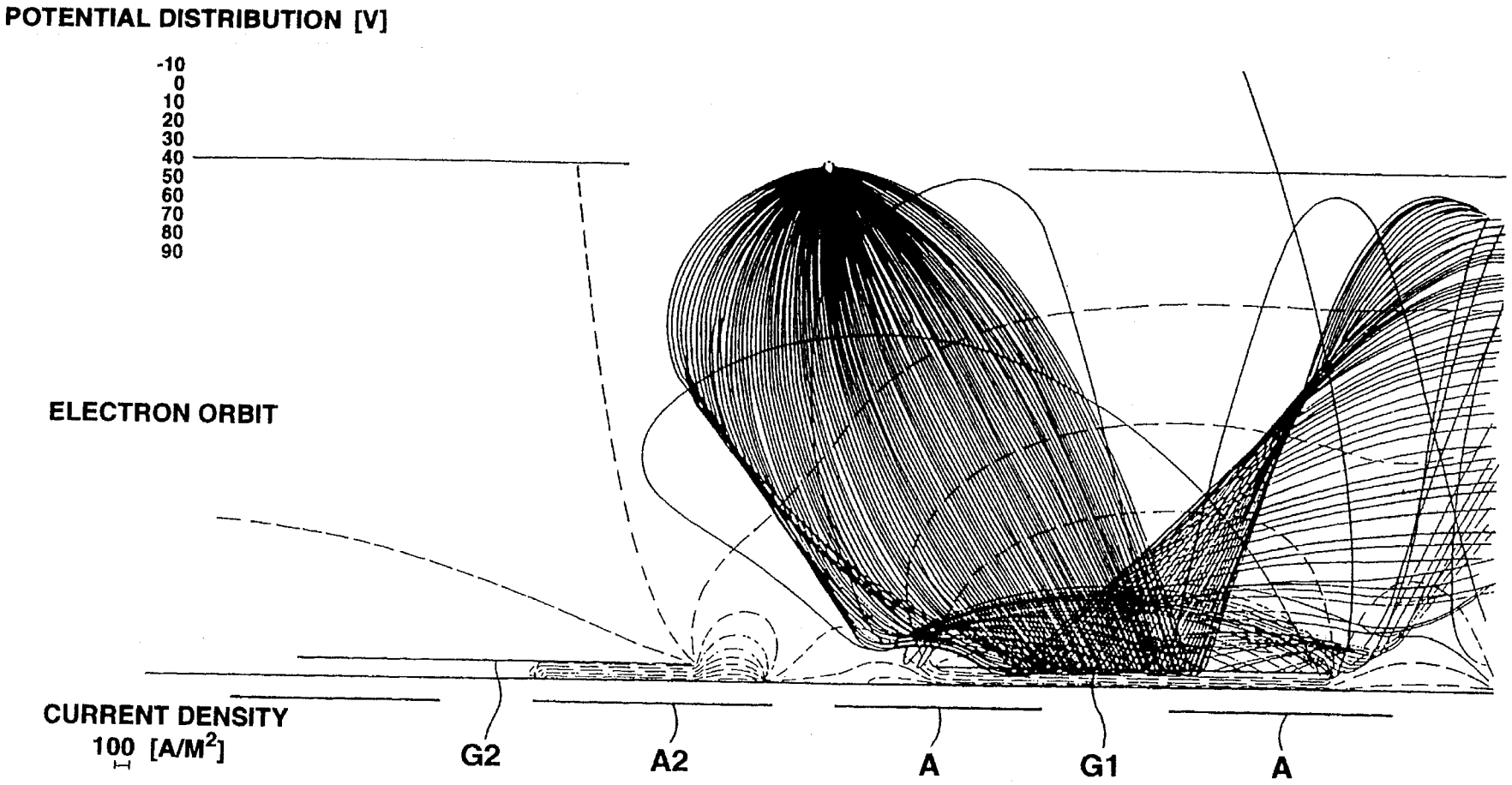
FIG. 3 is a graphical representation showing electron orbits and a potential distribution in a second embodiment of a fluorescent display device according to the present invention.
Figure 4:
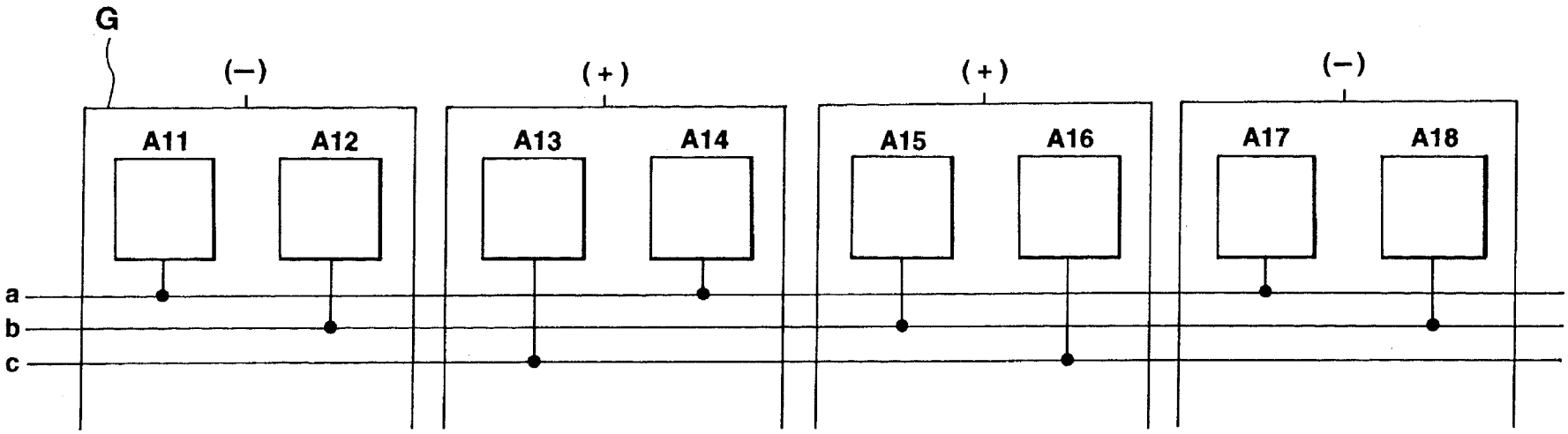
FIG.4 PRIOR ART
FIG. 4 is a schematic diagrammatic view showing a conventional graphic fluorescent display device.
Figure 5:
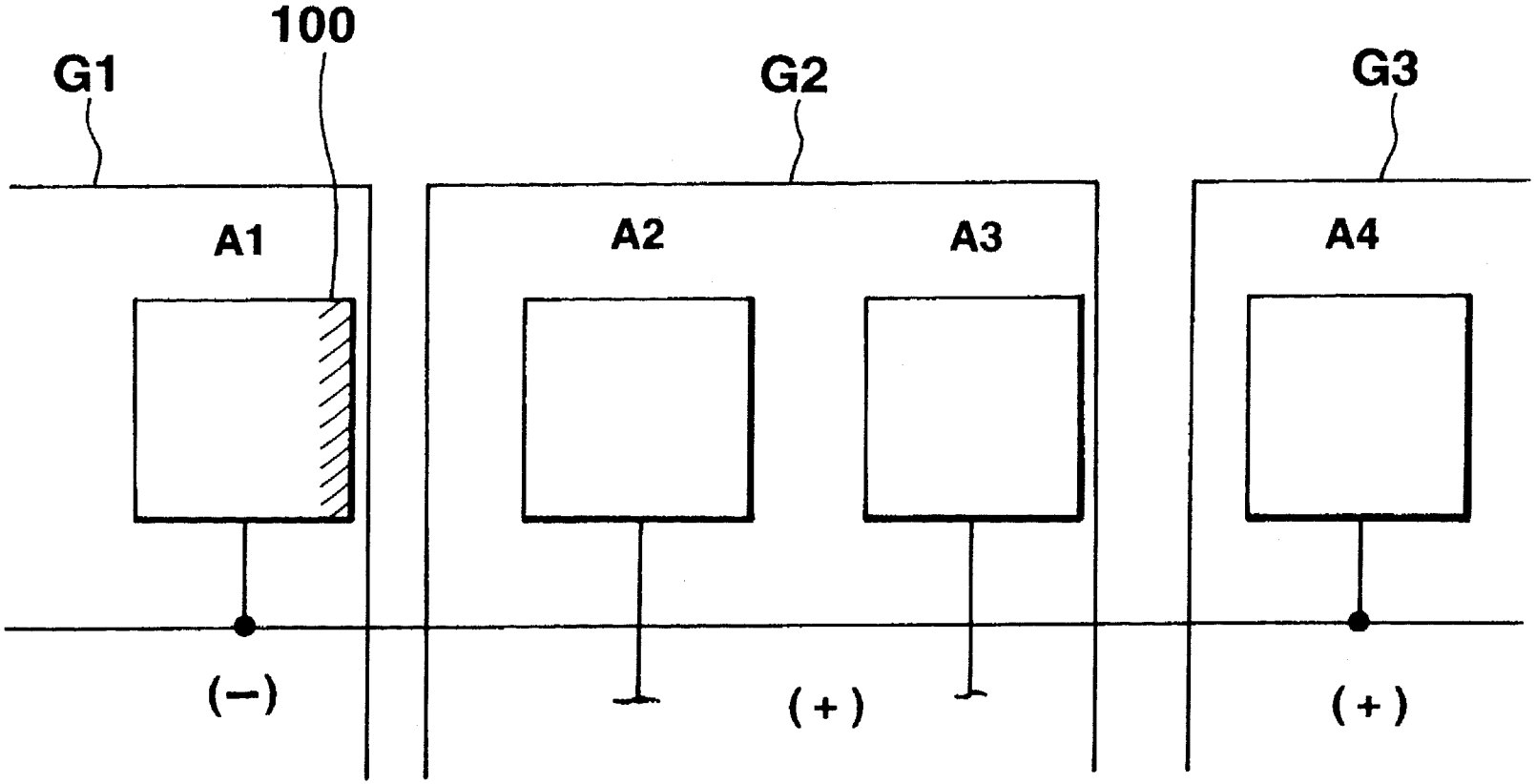
FIG.5 PRIOR ART
FIG. 5 is a schematic diagrammatic view showing a disadvantage of the conventional graphic fluorescent display device of FIG. 4.

Referring first to FIGS. 1 and 2, a first embodiment of a fluorescent display device according to the present invention is illustrated. In a fluorescent display device of the illustrated embodiment, an anode substrate constituting a part of an envelope is provided on an inner surface thereof with a plurality of anode segments A of a square configuration in a matrix-like manner. Rows of the matrix of the anode segments A each are provided with three wiring conductors, wherein the anode segments A of each row are connected to the same wiring conductors at every third interval.

Above the anode segments A are arranged a plurality of mesh grids G in such a manner that each of the mesh grids G is allocated for every two columns of the matrix. The anode segments A of each column of the matrix corresponding to each of the mesh grids are arranged so as to partially project from an outer edge of the mesh grid G.

The fluorescent display device of the illustrated embodiment may be driven according to any conventional procedure widely known in the art.

A positional relationship between the mesh grids G and the anode segments A arranged as described above may be represented by dimensions thereof. More particularly, supposing that one side of each of the anode segments A has a length $L_A$ of 0.45 mm, a pitch P of arrangement of the anode segments A is 0.65 mm, a width $L_G$ of the mesh grid G or a length thereof in a direction of the row of the matrix is 0.8 mm, and a length l of a portion of the anode segment A outwardly extending from the mesh grid G or a dimension in the direction of the row is one third as large as the length $L_A$ of the side of the anode segment A or 0.15 mm; an interval between each adjacent two mesh grids G is permitted to be increased to a magnitude as large as 0.5 mm irrespective of the fact that $L_A$ and P are set to be the same as in the conventional fluorescent display device. This indicates that the interval is increased to a level five times as large as that in the conventional fluorescent display device.

Thus, the illustrated embodiment permits the interval between the mesh grids adjacent to each other to be substantially increased as compared with that in the prior art, to thereby significantly facilitate an operation of adhesively fixing the mesh grids G directly on the anode segments.

FIG. 2 shows a potential distribution (chain lines) and electron orbits exhibited in the envelope when the fluorescent display device of the illustrated embodiment is driven, wherein reference character C designates a filamentary cathode. When the anode segments A and mesh grids G are applied thereto such voltages as shown in FIG. 2, electrons are caused to be directed to a mesh grid G1 selected at a positive voltage but fail to travel toward a mesh grid G2 to which a negative voltage is applied. An anode segment A2 positioned below the mesh grid G2 having the negative voltage applied thereto is arranged so as to partially outwardly project from the mesh grids G like the other anode segments and applied thereto a positive voltage. However, the anode segment A2 is arranged so as to be separated from the mesh grid G1 by a sufficient distance, to thereby effectively prevent leakage luminance due to impingement of electrons thereon.

Now, a second embodiment of a fluorescent display device according to the present invention will be described hereinafter. A basic pattern of arrangement of electrodes, a connection structure and a drive procedure in the second embodiment may be set in substantially the same manner as those in the first embodiment. Dimensions and arrangement of anode segments A and mesh grids G will be described now.

In the second embodiment, a length $L_A$ of one side of each of the anode segments A is set to be 0.72 mm, a pitch P of arrangement of anode segments A is set at 1.04 mm, a width $L_G$ of each of the mesh grids G or a length thereof in a direction of a row of a matrix is set at 1.28 mm and a length l of a portion of each anode segment A outwardly extending from the mesh grid G in the direction of the row is set to be one third as large as the length $L_A$ of the side of the anode segment A or 0.24 mm.

Thus, the second embodiment indicates that when the dimensions of the electrodes are increased as compared with those in the first embodiment under the conditions that the anode segments A each are arranged so as to outwardly project by a distance one third as large as the length $L_A$ of one side of the anode segment from the mesh grid G as in the first embodiment, leakage luminance is effectively prevented until the dimensions are increased to a level six times as large as those in the first embodiment. More particularly, as shown in FIG. 3, an anode segment A2 to which a positive voltage is applied is arranged so as to outwardly extend from below an unselected mesh grid positioned adjacent to a selected mesh grid G1, however, the above-described arrangement and construction of the second embodiment effectively prevent electrons from impinging on the portion of the anode segment A2.

Also, the second embodiment permits an interval between each adjacent two mesh grids to be increased to a magnitude as large as 0.8 mm, to thereby further facilitate an operation of arranging the mesh grids.

As can be seen from the foregoing, the fluorescent display device of the present invention is constructed in the manner that the anode segments each are so arranged that a part of each of the anode segments outwardly projects from the mesh grids. Such construction of the present invention exhibits significant advantages.

One of the advantages is that an interval between the mesh grids adjacent to each other is significantly increased because the mesh grids are positioned inside the anode segments. This effectively prevents leakage luminance from the adjacent anode segment even when the mesh grids are arranged while being deviated by a distance as large as about 0.1 mm which corresponds to an interval between the grids in the prior art.

Another advantage is that an operation of mounting the mesh grids is highly facilitated even in a dot matrix type fluorescent display device because an interval between the mesh grids is significantly increased.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

an anode substrate which constitutes part of an envelope;

a plurality of anode segments arranged in a matrix on an inner surface of said anode substrate, each of said anode segments having a phosphor deposited thereon;

a plurality of mesh grids formed on said anode segments such that each mesh grid partially covers two adjacent rows of anode segments, one edge of each of said anode segments protruding beyond said mesh grids and not being covered thereby; and a plurality of wiring conductors, each of which is connected to anode segments in a row at predetermined intervals.

2. A fluorescent display device according to claim 1, wherein said anode segments are of a dot-like shape and a plurality of which are controlled by one of said mesh grids.

* * * * *

UNITED STATES PATENT AND TRADEMARK OFFICE

CERTIFICATE OF CORRECTION

PATENT NO. : 5,510,672

DATED : April 23, 1996

INVENTOR(S) : Yoshiaki WASHIO, et al.

It is certified that error appears in the above-indentified patent and that said Letters Patent is hereby corrected as shown below:

On the title page, Item [30], the Foreign Application Priority Data, is missing. It should read:

--[30] FOREIGN APPLICATION PRIORITY DATA
Jan. 18, 1993 [JP] JAPAN 5-005917--

Signed and Sealed this

Third Day of September, 1996

*Attest:*

Bruce Lehman

BRUCE LEHMAN

*Attesting Officer*

*Commissioner of Patents and Trademarks*